US007607662B2

(12) United States Patent
Nireki

(10) Patent No.: US 7,607,662 B2
(45) Date of Patent: Oct. 27, 2009

(54) BILL HANDLING APPARATUS

(75) Inventor: Takao Nireki, Tokyo (JP)

(73) Assignees: Aruze Corp., Tokyo (JP); Seta Corp., Tokyo (JP)

( * ) Notice: Subject to any disclaimer, the term of this patent is extended or adjusted under 35 U.S.C. 154(b) by 0 days.

(21) Appl. No.: 11/839,883

(22) Filed: Aug. 16, 2007

(65) Prior Publication Data

US 2008/0048017 A1 Feb. 28, 2008

(30) Foreign Application Priority Data

Aug. 22, 2006 (JP) ..... 2006-225751

(51) Int. Cl.
*B65H 5/34* (2006.01)

(52) U.S. Cl. ..... 271/270; 271/265.01

(58) Field of Classification Search ..... 271/264, 271/265.01, 266, 270; 209/534
See application file for complete search history.

(56) References Cited

U.S. PATENT DOCUMENTS 4,874,161 A * 10/1989 Murasaki et al. ..... 271/265.01
5,541,393 A 7/1996 Ikezawa et al.
6,937,752 B2 8/2005 Chiba et al.
7,422,095 B2 * 9/2008 Yoshioka ..... 194/206
2003/0198373 A1 10/2003 Raterman et al.
2004/0150154 A1 8/2004 Howe
2004/0182675 A1 9/2004 Long et al.
2005/0131823 A1 6/2005 Elwin et al.
2008/0048017 A1 2/2008 Nireki

FOREIGN PATENT DOCUMENTS

| | | |
|---|---|---|
| JP | 04-077754 | 3/1992 |
| JP | 05-069965 | 3/1993 |
| JP | 3580468 | 7/2004 |
| WO | WO 94/19773 | 9/1994 |

OTHER PUBLICATIONS

U.S. Appl. No. 11/839,818, filed Aug. 16, 2007, Nireki.
U.S. Appl. No. 11/839,787, filed Aug. 16, 2007, Nireki.

* cited by examiner

*Primary Examiner*—Kaitlin S Joerger
(74) *Attorney, Agent, or Firm*—Oblon, Spivak, McClelland, Maier & Neustadt, L.L.P.

(57) ABSTRACT

A bill handling apparatus according to one embodiment of the invention has a bill insertion slot into which a bill is inserted, a bill feeding mechanism for feeding the bill inserted from the bill insertion slot in the insertion direction, a bill reading section for reading the bill fed by the bill feeding mechanism, and a control section for controlling a bill feeding speed by the bill feeding mechanism in a plurality of kinds of speeds.

8 Claims, 8 Drawing Sheets

BILL HANDLING APPARATUS

The present disclosure relates to subject matter contained in Japan Patent Application No. 2006-225751 filed on Aug. 22, 2006, which is expressly incorporated herein by reference in its entireties.

BACKGROUND OF THE INVENTION

The present invention relates to a bill handling apparatus for feeding a bill inserted from a bill insertion slot, while reading the fed bill to identify the validity.

Generally, a bill handling apparatus identifies the validity of a bill inserted from a bill insertion slot by a user, and is incorporated into service apparatuses that provides various kinds of products and service corresponding to the bill value judged as being valid, such as, for example, a game media lending machine installed in a game hole, or an automatic dispenser, ticket-vending machine and the like installed in public areas.

The bill handling apparatus is usually provided with operation devices such as a bill feeding mechanism that feeds a bill inserted into a bill insertion slot, bill reading means for executing readout of the fed bill, bill identifying means for identifying the validity (also referred to as authentication judgment) from the read bill information and the like, and control means for driving and controlling the operation devices.

In the above-mentioned bill handling apparatus, it is possible to perform high-speed processing as the entire apparatus by controlling the feeding speed of the bill to be fast, while improving the bill identification accuracy by controlling the bill processing speed to be low. For example, disclosed in Japanese Patent No. 3580468 is a bill handling apparatus enabling optimal bill separation and stack control corresponding to the feeding speed to be able to vary the feeding speed of a bill corresponding to transaction. The bill handling apparatus is configured to feed a bill at a low speed again to re-identify when rejection occurs when the bill is fed at a high speed.

However, the bill handling apparatuses are usually used in various forms and environments, and when a problem occurs such as deterioration of identification accuracy and the like and maintenance is required, under circumstances where the apparatus is installed at a location some distance, a number of apparatuses are installed and the like, such a case arises that a clerk or staff is not able to support promptly. In the above-mentioned conventional bill handling apparatus, when the bill identification accuracy deteriorates, since a bill is always fed at a high speed in initial identification, a series of processing is executed of high-speed identification processing, reject processing, and low-speed identification processing, and a problem arises that the bill identification time is long.

Accordingly, a bill handling apparatus is required that enables the bill identification accuracy to be improved with easy procedures even when the bill identification accuracy deteriorates.

BRIEF SUMMARY OF THE INVENTION

To achieve the above-mentioned object, a bill handling apparatus according to the present invention is characterized by having a bill insertion slot into which a bill is inserted, a bill feeding mechanism for feeding the bill inserted from the bill insertion slot in the insertion direction, a bill reading section for reading the bill fed by the bill feeding mechanism, and a control section for controlling a bill feeding speed by the bill feeding mechanism in a plurality of kinds of speeds.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the invention will be described below with reference to accompanying drawings.

Figure 1:
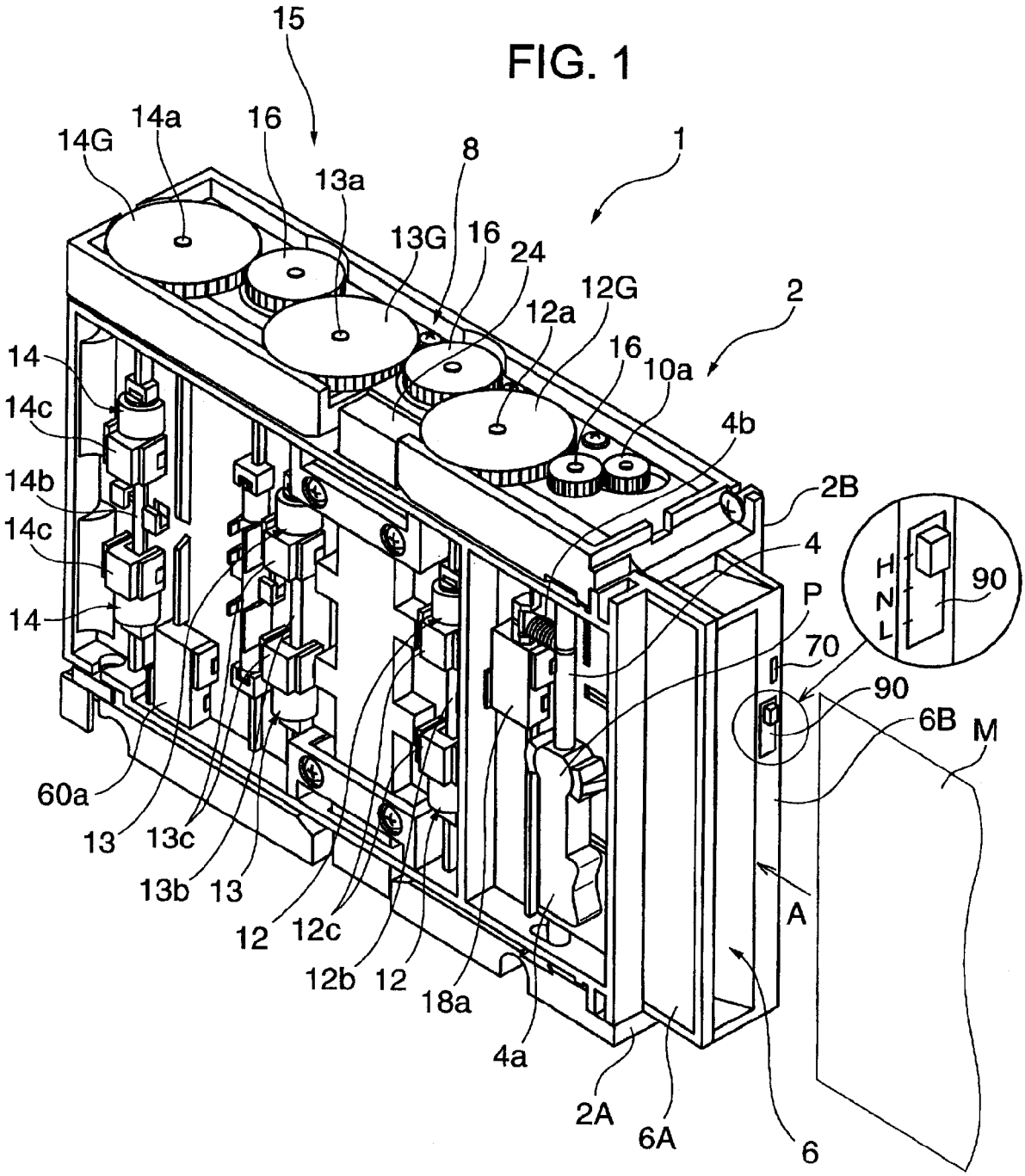
FIG. 1 is a perspective view showing an entire configuration of one embodiment of a bill handling apparatus according to the invention.
Figure 2:
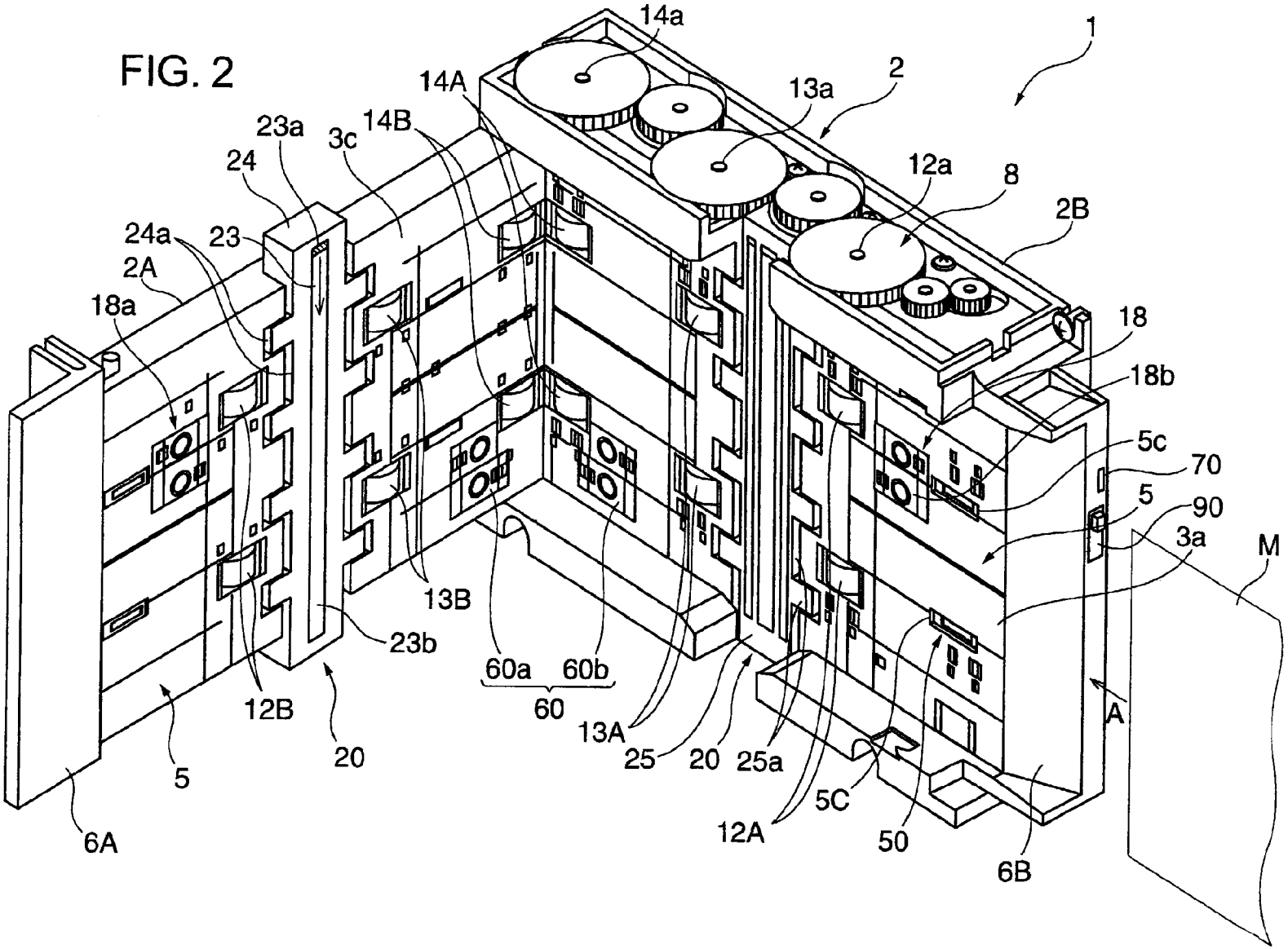
FIG. 2 is a perspective view showing a state where an upper frame is opened with respect to a lower frame.
Figure 3:
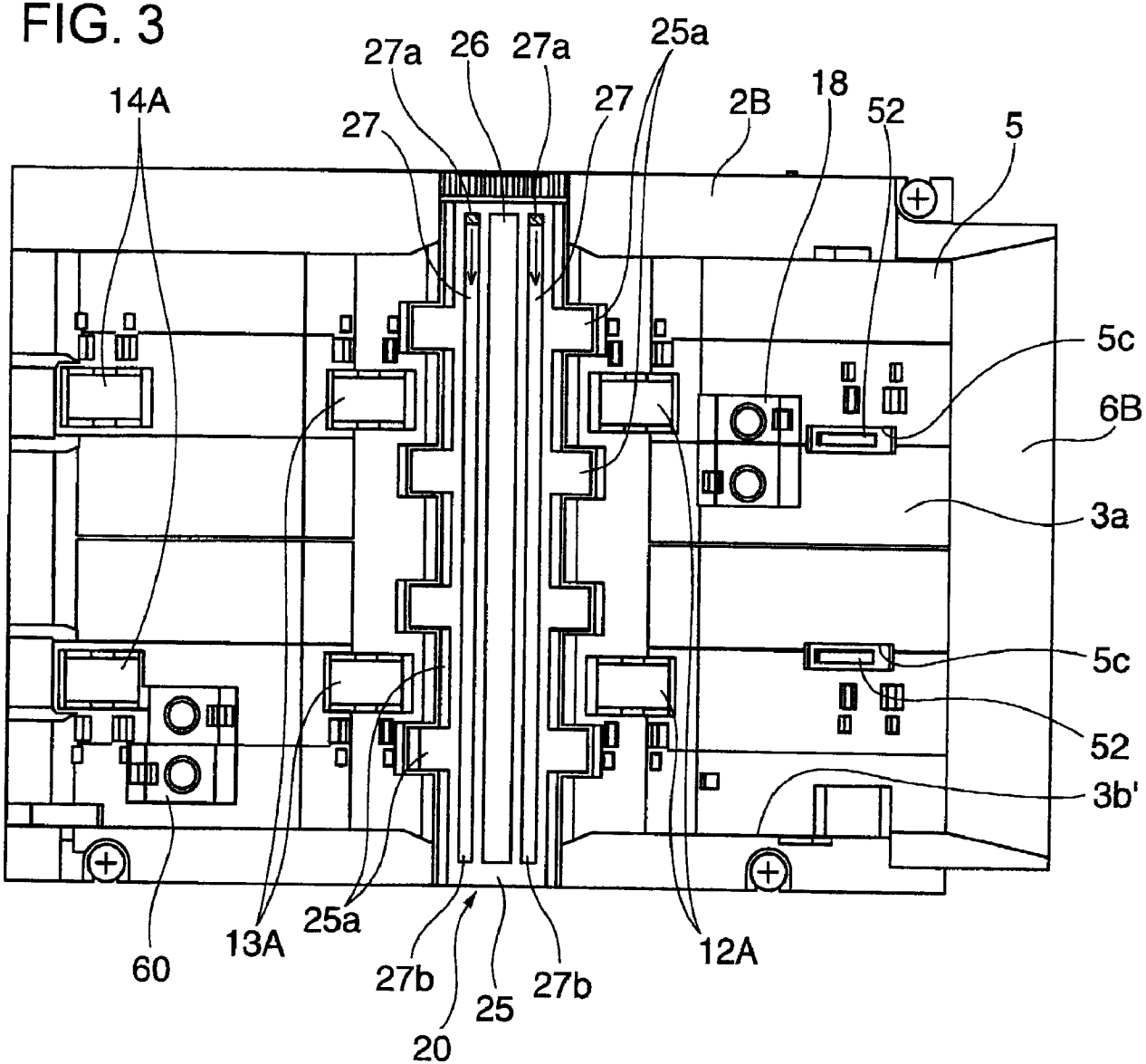
FIG. 3 is a plan view showing a bill feeding path portion of the lower frame.
Figure 4:
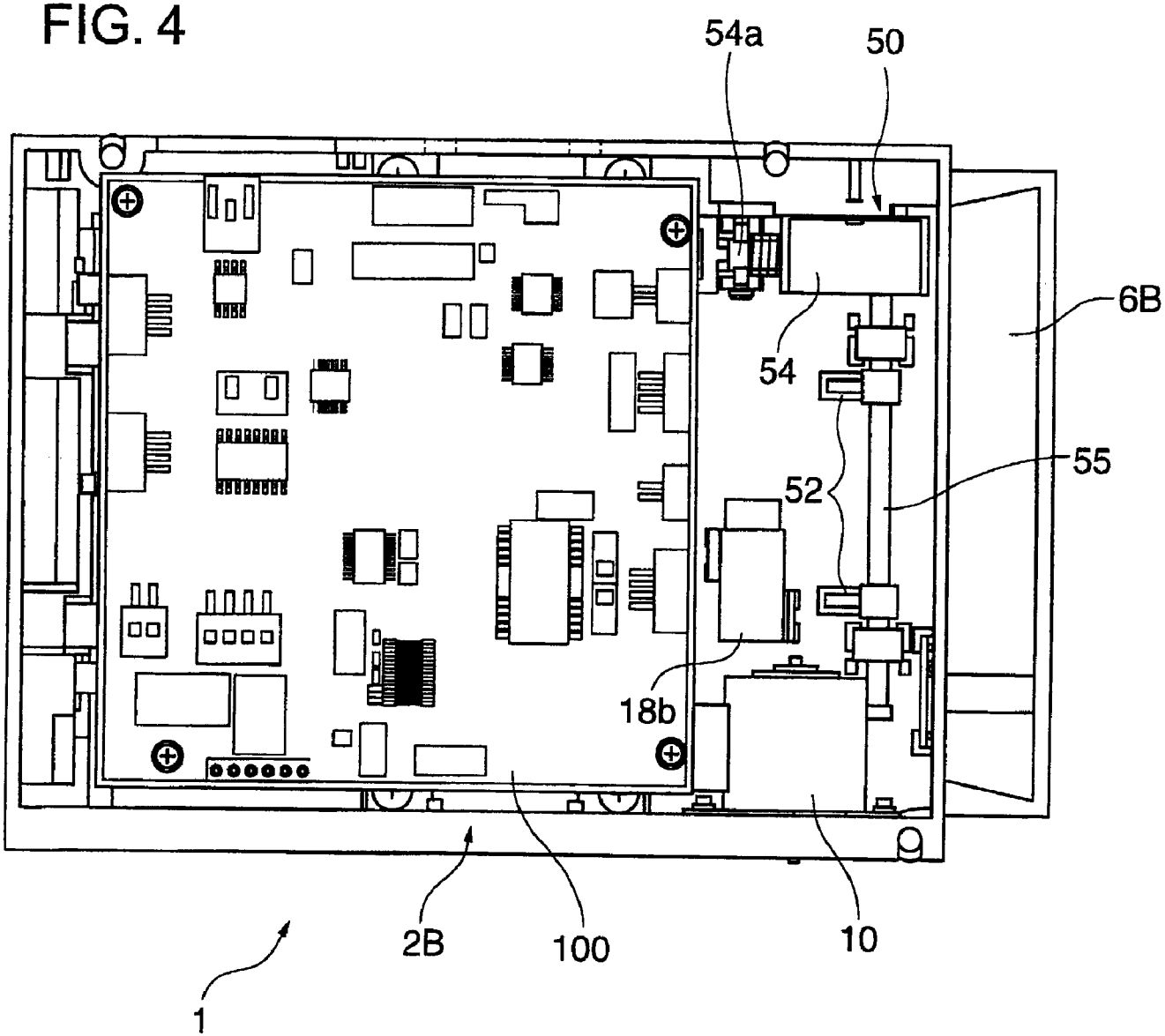
FIG. 4 is a rear elevational view of the lower frame.

FIGS. 1 to 4 are views showing a configuration of a bill handling apparatus according to this embodiment, FIG. 1 is a perspective view showing an entire configuration, FIG. 2 is a perspective view showing a state where an upper frame is opened with respect to a lower frame, FIG. 3 is a plan view showing a bill feeding path portion of the lower frame, and FIG. 4 is a rear elevational view of the lower frame.

A bill handling apparatus 1 of this embodiment is configured to be capable of being incorporated into a game media lending apparatus (not shown) installed among various kinds of game machines such as, for example, slot machines and the like. In this case, the game media lending apparatus may be provided with another apparatus (for example, a bill storage unit, coin identifying apparatus, storage media processing apparatus, power supply apparatus and the like) on the upper or lower side of the bill handling apparatus 1, and the bill handling apparatus 1 may be formed integrally with the other apparatus, or formed separately. Then, when a bill is inserted in such a bill handling apparatus 1 and the validity of the inserted bill is judged, the processing corresponding to the bill value is performed such as the processing for lending game media, the processing of writing in a storage medium such as a prepaid card, or like.

The bill handling apparatus 1 is provided with a frame 2 formed in the shape of a substantially cuboid, and the frame 2 is mounted to a locking portion of the game media lending apparatus not shown in the figure. The frame 2 has a lower frame 2B as a base side and an upper frame 2A openable/ closeable with respect to the lower frame 2B to cover the lower frame 2B. The frames 2A and 2B are configured to be opened and closed with a base portion as a turn center as shown in FIG. 2.

The lower frame 2B has the shape of a substantially cuboid, and is provided with a bill feeding face 3*a* for feeding a bill, and side wall portions 3*b* formed on the opposite sides of the bill feeding face 3*a*. Meanwhile, the upper frame 2A is configured in the shape of a plate provided with a bill feeding face 3*c*, and when the upper frame 2A is closed to enter between the side wall portions 3*b* on the opposite sides of the lower frame 2B, a clearance (bill feeding path) 5 to feed a bill is formed between opposite portions of the bill feeding face 3*a* and bill feeding face 3*c*.

Then, the upper frame 2A and lower frame 2B are respectively provided with bill insertion portions 6A and 6B adapted to the bill feeding path 5. These bill insertion portions 6A and 6B form a bill insertion slot 6 in the shape of a slit when the upper frame 2A and lower frame 2B are closed, and as shown in FIG. 1, a bill M is inserted inside from a shorter side of the bill along the direction of allow A.

Further, a lock shaft 4 capable of locking in the lower frame 2B is disposed on the front end side of the upper frame 2A. The lock shaft 4 is provided with an operation portion 4*a*, and by operating the operation portion 4*a* to rotate against the biasing force of a biasing spring 4*b*, rotates on a pivot P as a center to release the lock state of the upper frame 2A and lower frame 2B (the state where the frames are closed: overlapping state).

In the lower frame 2B are provided a bill feeding mechanism 8, a bill detecting sensor 18 that detects a bill inserted in the bill insertion slot 6, bill reading means 20 that is installed on the downstream side of the bill detecting sensor 18 and that reads information of the bill in a fed state, a shutter mechanism 50 that is installed in the bill feeding path 5 between the bill insertion slot 6 and the bill detecting sensor 18 and that is driven to block the bill insertion slot 6, and control means (a control section; circuit control board) 100 for controlling driving of structural members such as the aforementioned bill feeding mechanism 8, bill reading means(a bill reading section) 20, shutter mechanism 50 and the like, while identifying (performing authentication judgment processing) the validity of the read bill.

The bill feeding mechanism 8 is a mechanism capable of feeding the bill inserted from the bill insertion slot 6 along the insertion direction A, while feeding back the bill in an insertion state toward the bill insertion slot 6. The bill feeding mechanism 8 is provided with a driving motor 10 that is a driving source installed on the lower frame 2B side, and feeding roller pairs 12, 13 and 14 which are driven to rotate by the driving motor 10 and disposed in the bill feeding path 5 at predetermined intervals along the bill feeding direction.

In addition, the driving motor 10 of this embodiment is comprised of a stepping motor to be able to control the feeding speed and the like with ease. In other words, the stepping motor is controlled so that the driving speed (bill feeding speed) is switched between a plurality of kinds (feeding speeds of two modes or more) by a motor driving pulse output section, while being controlled in the rotation direction (bill feeding direction).

The feeding roller pair 12 is provided with driving rollers 12A disposed on the lower frame 2B side, and pinch rollers 12B disposed on the upper frame 2A side to come into contact with the driving roller 12A. These driving rollers 12A and pinch rollers 12B are installed in two respective locations at predetermined intervals along the direction perpendicular to the bill feeding direction. These driving rollers 12A and pinch rollers 12B are exposed at their parts to the bill feeding path 5.

The driving rollers 12A installed in two respective positions are fixed to a driving shaft 12*a* rotatably supported by the lower frame 2B, and the two pinch rollers 12B are rotatably supported by a spindle 12*b* supported by the upper frame 2A. In this case, a biasing member 12*c* for biasing the spindle 12*b* to the driving shaft 12*a* side is provided in the upper frame 2A, and brings the pinch rollers 12B into contact with the driving roller side 12A by predetermined pressure.

In addition, as in the roller pair 12, the feeding roller pairs 13 and 14 are respectively comprised of two driving rollers 13A, 14A fixed to driving shafts 13*a*, 14*a*, and two pinch rollers 13B, 14B rotatably supported by spindles 13*b*, 14*b*, and the pinch rollers 13B, 14B are brought into contact with the driving rollers 13A, 14A by biasing members 13*c*, 14*c*, respectively.

The feeding roller pairs 12, 13 and 14 are driven in synchronization with one another by a driving force conveying mechanism 15 coupled to the driving motor 10. The driving force conveying mechanism 15 is comprised of a gear train disposed rotatably on one side wall portion 3*b* of the lower frame 2B. More specifically, the mechanism 15 is formed of the gear train having an output gear 10*a* fixed to an output shaft of the driving motor 10, input gears 12G, 13G and 14G which are sequentially engaged in the output gear 10*a* and mounted on the end portions of the driving shafts 12*a*, 13*a* and 14*a*, respectively and idle gears 16 installed between the gears.

According to the above-mentioned configuration, when the driving motor 10 is driven forward, each of the feeding roller pairs 12, 13 and 14 is driven to feed the bill in the insertion direction A, while when the driving motor 10 is driven reversely, being driven reversely to send the bill back to the bill insertion slot side.

Figure 5:
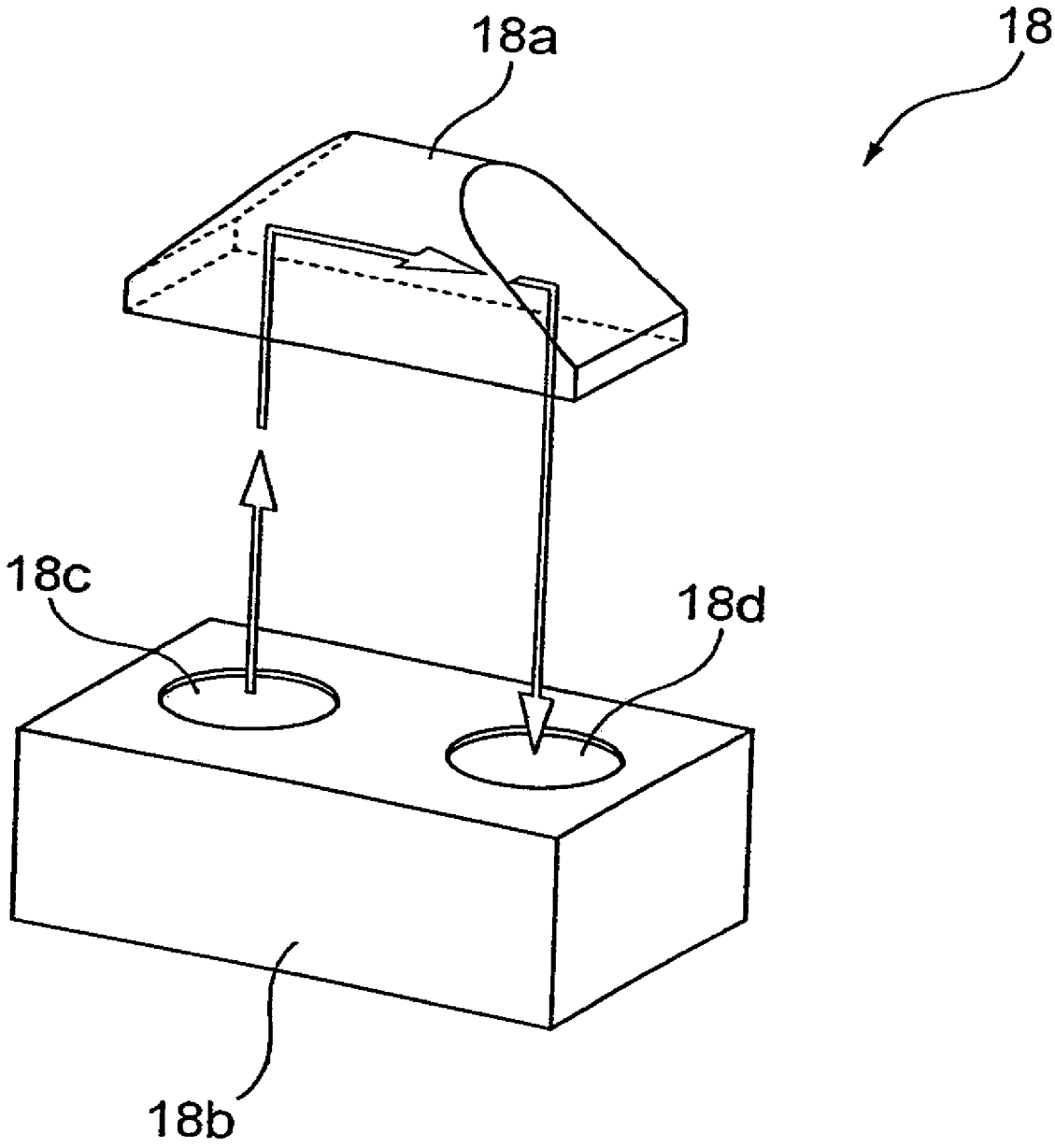
FIG. 5 is a perspective view showing a configuration of a bill detecting sensor.
Figure 6:
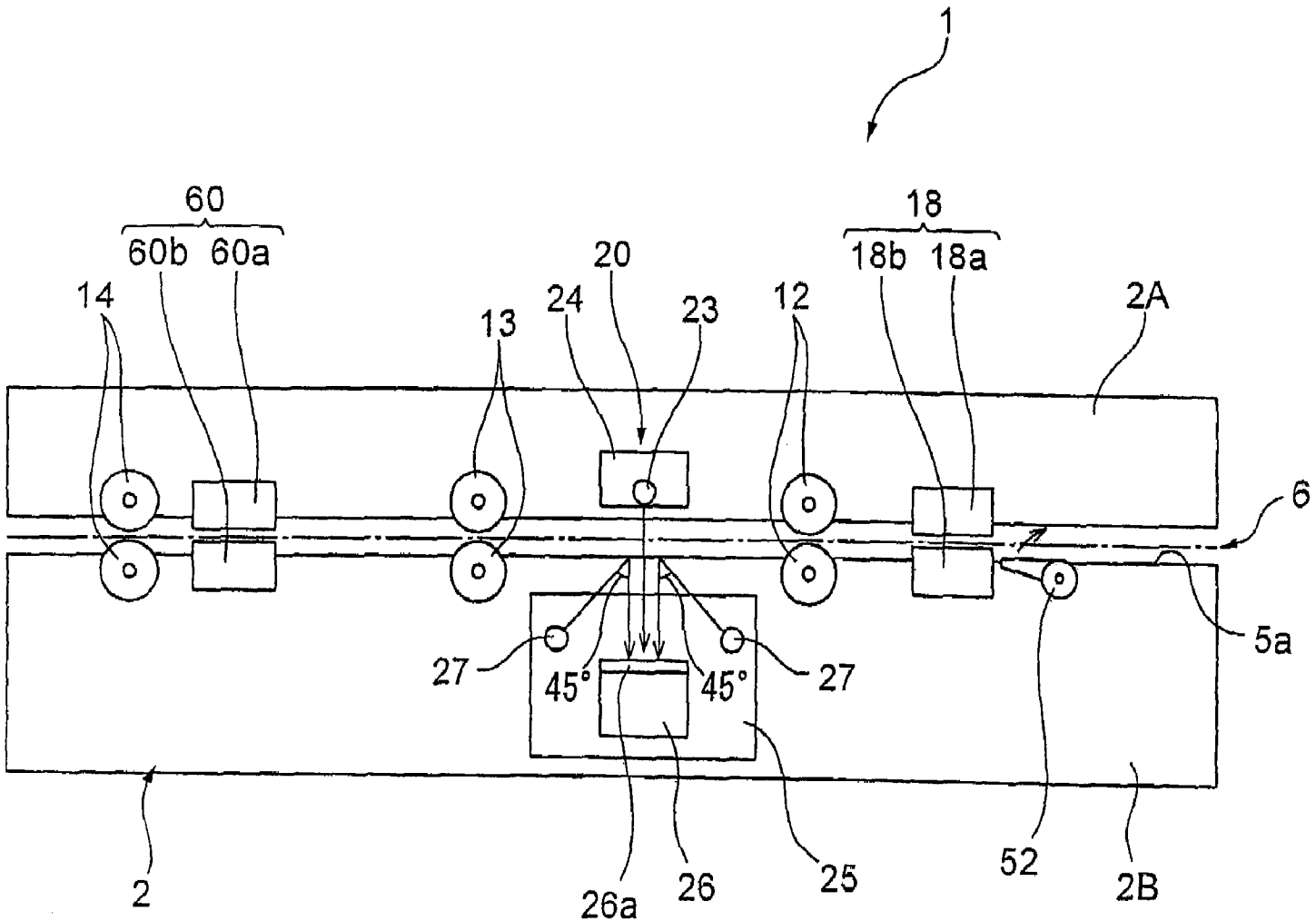
FIG. 6 is a view schematically showing the configuration of the bill handling apparatus.

The bill detecting sensor 18 is to generate a detection signal in detecting a bill inserted in the bill insertion slot 6, and in this embodiment, is installed between rotating pieces constituting the shutter mechanism described later, and the bill reading means 20 for reading the bill. The bill detecting sensor 18 is comprised of, for example, an optical type sensor, more specifically, a regression reflective photosensor, and as shown in FIG. 5, formed of a prism 18*a* installed on the upper frame 2A side and a sensor body 18*b* installed on the lower frame 2B side. More specifically, the prism 18*a* and sensor body 18*b* are arranged in such a manner that light emitted from a light-emitting portion 18*c* of the sensor body 18*b* is detected by a light-receiving portion 18*d* of the sensor body 18*b* thorough the prism 18*a*. When a bill is passed through the bill feeding path 5 positioned between the prism 18*a* and sensor body 18*b* and the light is not detected in the light-receiving portion 18*d*, the sensor 18 generates a detection signal.

In addition, the bill detecting sensor 18 may be comprised of a mechanical type sensor, as well as the optical type sensor.

On the downstream side of the bill detecting sensor 18 is installed the bill reading means 20 for reading the bill information on the bill in a fed state. The bill reading means 20 is only required to have a configuration for irradiating the bill with the light to read the bill information when the bill is fed by the bill feeding mechanism 8, and generating a signal to enable the validity (authentication) of the bill to be judged, and in this embodiment, is configured to perform readout of the bill by applying the light from the opposite sides, and detecting the transmitted light and reflected light by a light-receiving device such as a photodiode or the like. Then, the optical signal on the read bill information undergoes photoelectric transformation, and is compared with the beforehand stored data of the authorized bill in the bill identifying means, and the authentication of the fed bill is thus judged.

On the downstream side of the bill insertion slot 6 is disposed the shutter mechanism 50 that blocks the bill insertion slot 6. The shutter mechanism 50 is configured to be normally in a state for opening the bill insertion slot 6, closed when a bill is inserted and the bill detecting sensor 18 detects a rear end of the bill (the bill detecting sensor 18 is OFF), and thus prevent fraud and the like.

More specifically, the shutter mechanism 50 has the rotating pieces 52 that are rotatably driven to appear at predetermined intervals in the direction perpendicular to the bill feeding direction in the bill feeding path 5, and a solenoid (pull-type) 54 that is a driving source that rotatably drives the rotating pieces 52. In this case, the rotating pieces 52 are installed in two locations in the width direction of a spindle 55, and long holes 5*c* extending in the bill feeding direction are formed in the bill feeding face 3*a* of the lower frame 2B constituting the bill feeding path 5 to cause respective rotating pieces 52 to appear.

Further, on the downstream side of the bill reading means 20 is provided a bill passage detecting sensor 60 that detects passage of the bill. The bill passage detecting sensor 60 is to generate a detection signal when the bill judged as being valid is further fed to the downstream side, and the sensor 60 detects the rear end of the bill. Based on the occurrence of the detection signal, the energization of the solenoid 54 is released (the solenoid is OFF), and the driving shaft 54*a* moves in the protruding direction by the biasing force of the biasing spring provided in the driving shaft 54*a*. By this means, the rotating pieces 52 constituting the shutter mechanism are rotatably driven to open the bill feeding path via the spindle 55 synchronized with the driving shaft 54*a*.

The bill passage detecting sensor 60 is, as in the bill detecting sensor 18, comprised of an optical type sensor (regression reflective photosensor), and formed of a prism 60*a* installed on the upper frame 2A side and a sensor body 60*b* installed on the lower frame 2B side. Naturally, the bill passage detecting sensor 60 may be comprised of a mechanical type sensor, as well as the optical type sensor.

In the vicinity of the bill insertion slot 6 is provided an informing device that informs that the bill is being inserted in a visible manner. Such an informing device can be comprised of, for example, an LED 70 that blinks, is lit when a user inserts a bill in the bill insertion slot 6, and informs the user of the bill being handled. It is thereby possible to prevent the user from erroneously inserting a next bill.

Further, in this embodiment, switch signal generating means (a switch signal generating section) is provided for generating a signal to switch the driving speed in controlling the driving speed (bill feeding speed) of the driving motor 10. In other words, the control means (control board 100) is capable of controlling the stepping motor that is the driving motor and varying the bill feeding speed based on a switch signal from the switch signal generating means.

As shown in FIGS. 1 and 2, the switch signal generating means of this embodiment is installed in an exposed portion (in the vicinity of the bill insertion slot 6) that is a position for users to be able to operate, and is comprised of an operational switch 90 enabling the feeding speed to be switched. More specifically, switching between bill feeding speeds in this embodiment is configured to enable switching between three modes of a high-speed mode, normal-speed mode and low-speed mode (OCR mode), and a bill inserter operates the operational switch 90 in the vertical direction to change, and is thereby capable of selecting the speed. In this case, the high-speed mode is a mode to select in increasing the bill feeding speed to improve the bill handling speed. The normal-speed mode is a mode to select in making the bill feeding speed lower than in the high-speed mode to improve the identification processing accuracy. In other words, this mode increases a data amount of the read bill, and thus makes the identification accuracy higher than in the high-speed mode. Further, the low-speed mode (OCR mode) is a mode to select in making the bill feeding speed still lower to enhance the identification processing accuracy to be still higher, and to enable identification of not only bills but also paper sheets (various kinds of coupons, gift certificates and the like) other than the bills.

In addition, two modes or more are only required as the above-mentioned modes, and the operational switch 90 may be provided in a position that a bill inserter (third party) is not able to operation i.e. a position enabling only a worker or the like to operate, for example, in the inner frame of the apparatus body or on the control board.

Referring to FIGS. 2 to 4 and 6, described below is the configuration of the bill reading means 20 installed in the upper frame 2A and lower frame 2B.

The bill reading means 20 has a light-emitting unit 24 provided with a first light-emitting portion 23 that is disposed on the upper frame 2A side and that is capable of emitting slit-shaped light over the feeding path width direction on the upper side of the fed bill, and a line sensor 25 disposed on the lower frame 2B side.

The line sensor 25 installed on the lower frame 2B side has a light-receiving portion 26 disposed opposite to the first light-emitting portion 23 in a manner of sandwiching the bill, and second light-emitting portions 27 that are disposed adjacent to opposite sides of the light-receiving portion 26 on the bill feeding direction and that are capable of emitting slit-shaped light.

The first light-emitting portion 23 disposed opposite to the light-receiving portion 26 of the line sensor 25 functions as a light source for transmission. As shown in FIG. 2, the first light-emitting portion 23 is formed as the so-called light guide member made of a synthetic resin formed in the shape of a rectangle rod, and preferably, has functions of receiving emitted light from the light-emitting device 23*a* such as an LED and the like installed at the end portion, and emitting the light while guiding the light along the longitudinal direction. By this means, it is possible to apply the slit-shaped light uniformly to the entire region in the width direction of the feeding path of the fed bill with a simple configuration.

In addition, the light-receiving portion 26 of the line sensor 25 is disposed in the shape of a line in parallel with the first light-emitting portion 23 that is the light guide member, and formed in the shape of a thin plate which extends in the direction of intersecting the bill feeding path 5, and which is formed in the shape of a band having a width to the extent of not affecting the sensitivity of a light-receiving sensor, not shown, provided in the light-receiving portion 26. More specifically, the portion 26 has a configuration where a plurality of CCDs (Charge Coupled Device) is provided in the shape of a line in the center in the thickness direction of the light-receiving portion 26, and a Selfoc lens array 26*a* is arranged in the shape of a line in a position above the CCDs to gather the transmitted light and reflected light.

The second light-emitting portions 27 of the line sensor 25 function as light sources for reflection. As shown in FIG. 3, each of the second light-emitting portions 27 is formed, as in the first light-emitting portion 23, as the so-called light guide member made of a synthetic resin formed in the shape of a rectangle rod, and preferably, has functions of receiving emitted light from the light-emitting device 27*a* such as an LED and the like installed at the end portion, and emitting the light while guiding the light along the longitudinal direction. By this means, it is possible to apply the slit-shaped light uniformly to the entire region in the width direction of the feeding path of the fed bill with a simple configuration.

In addition, each of the second light-emitting portions 27 is capable of applying the light to the bill at an elevation angle of 45 degrees, and is disposed so that the reflected light from the bill is received in the light-receiving portion 26 (light-receiving sensor). In this case, the light emitted from the second light-emitting portion 27 is input to the light-receiving portion 26 at an angle of 45 degrees, but the incident angle is not limited to 45 degrees, and can be set as appropriate in ranges capable of reliably receiving the reflected light. Therefore, an arrangement of the second light-emitting portions 27 and second light-receiving portion 26 can be modified in design as appropriate corresponding to the configuration of the bill handling apparatus. Further, the second light-emitting portions 27 are installed on the opposite sides with the light-receiving portion 26 sandwiched therebetween to emit the light from the opposite sides respectively at an angle of 45 degrees. This is because when a tear, crease and the like are present on the bill surface and the light is applied to a concavo-convex portion caused by a portion of the tear, crease or the like from only one side, a shaded area may be caused in the concavo-convex portion by shielding the light. Therefore, by emitting the light from the opposite sides, it is possible to prevent the concavo-convex portion from being darkened, and to obtain image data with higher accuracy than in emission from one side. Naturally, the second light-emitting portion 27 may be configured to be installed on only one side.

The line sensor 25 is exposed to the bill feeding path 5, and is thereby provided with concavo-convex portions 25*a*, as shown in FIG. 2, on opposite ends of its surface portion (that is substantially the same plane as the feeding face 3*a*) in the bill feeding direction to catch the fed bill hardly. Further, as in the line sensor 25, the light emitting unit 24 is provided with concavo-convex portions 24*a*, as shown in FIG. 2, on opposite ends of its surface portion in the bill feeding direction to catch the fed bill hardly.

Figure 7:
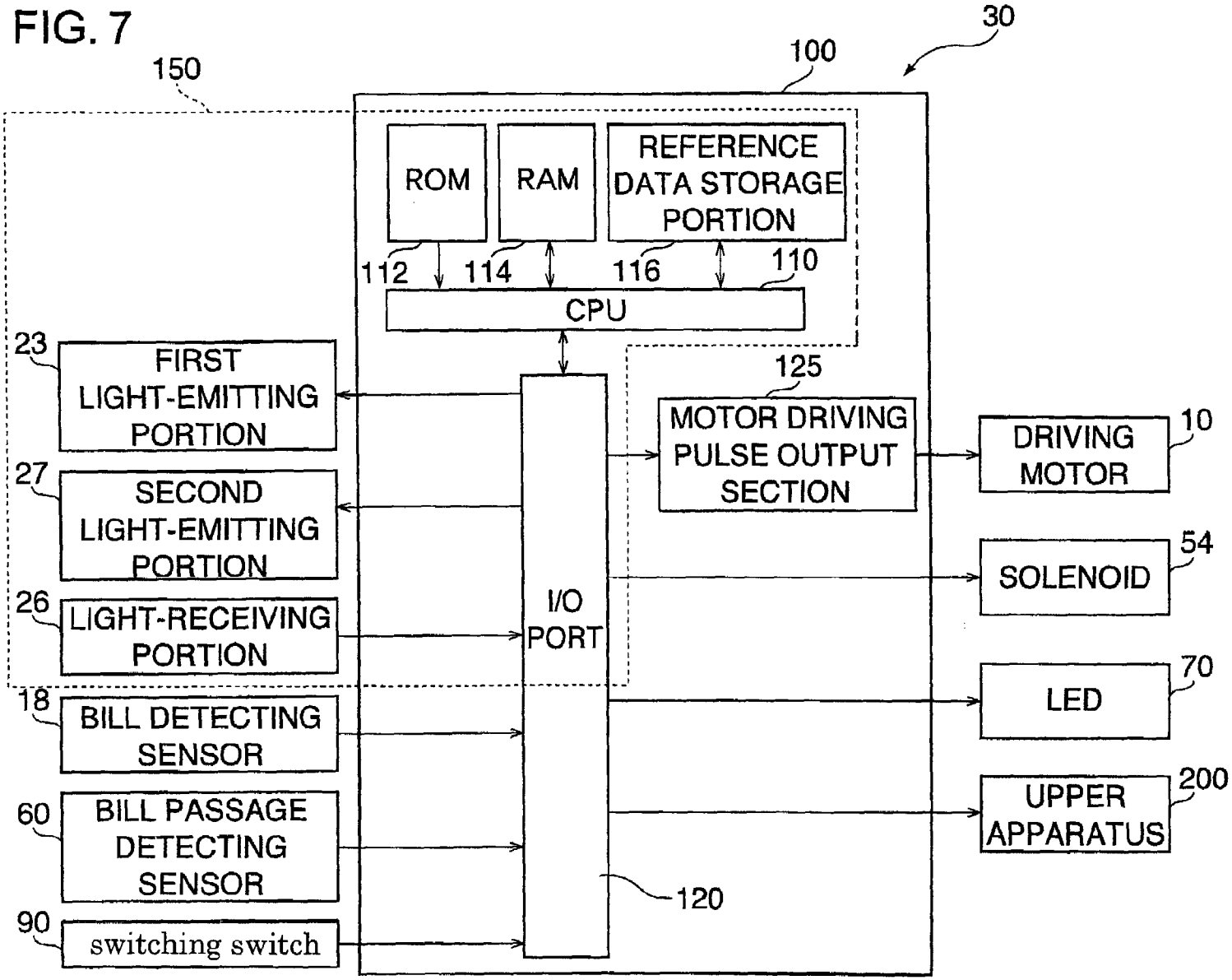
FIG. 7 is a block diagram illustrating a control system of the bill handling apparatus.

FIG. 7 is a block diagram illustrating a schematic configuration of the control means for controlling the bill handling apparatus 1 provided with the bill feeding mechanism 8, bill reading means 20, shutter mechanism 50 and the like.

The control means 30 is provided with the control board 100 for controlling the operation of each driving apparatus as described above. On the control board 100 are mounted a CPU (Central Processing Unit) 110 for controlling driving of each driving apparatus while constituting the bill identifying means, ROM (Read Only Memory) 112, RAM (Random Access Memory) 114 and a reference data storage section 116.

The ROM 112 stores operation programs for driving apparatuses such as the driving motor (stepping motor) 10, solenoid 54, LED 70 and the like, various kinds of programs such as an authentication judgment program and the like, and permanently data. The CPU 110 operates according to the programs stored in the ROM 112, inputs and outputs signals to/from the driving apparatuses as described above via an I/O port 120, and controls the operation of the bill handling apparatus. In other words, the CPU 110 is connected to a motor driving pulse output section 125 (driving motor 10), solenoid 54, and LED 70 via the I/O port 120. The driving apparatuses are controlled in operation by control signals from the CPU 110 according to the operation programs stored in the ROM 112. Further, the CPU 110 receives a detection signal from the bill detecting sensor 18, a detection signal from the bill passage detecting sensor 60, and a speed switch signal from the switching switch 90, and based on these detection signals and switch signal, controls the speed of the driving motor 10, forward/reverse driving of the driving motor 10, blinking of the LED 70, and driving of the solenoid 54.

The RAM 114 stores the data and programs used for the CPU 110 to operate, and acquires the received light data of a bill targeted for judgment to temporarily store. The data is compared with the reference data stored in the reference data storage section 116, and the authentication judgment processing is thereby performed. In addition, in this embodiment, the reference data is stored in the dedicated reference data storage section 116, but may be stored in the ROM 112. Further, although the reference data of the genuine bill may be stored beforehand in the reference data storage section 116, for example, the genuine bill is fed through the bill feeding mechanism 8 to acquire the received light data, and the data may be stored as the reference data.

Further, the CPU 110 is connected to the first light-emitting portion (light guide member) 23 in the light-emitting unit 24, and the light-receiving portion 26 and second light-emitting portions (light guide members) 27 in the line sensor 25 via the I/O port 120. These portions constitute a bill authentication judgment section 150 together with the CPU 110, ROM 112, RAM 114 and reference data storage section 116, and control the operations required fro the authentication judgment in the bill handling apparatus 1.

Furthermore, the CPU 110 is connected to a control section of the game media lending apparatus into which the bill handling apparatus 1 is incorporated, and an upper apparatus 200 such as a host computer and the like of an external apparatus, via the I/O port 120, and transmits various kinds of signals (such as information of the bill, alarm signal and the like) to the upper apparatus.

Figure 8:
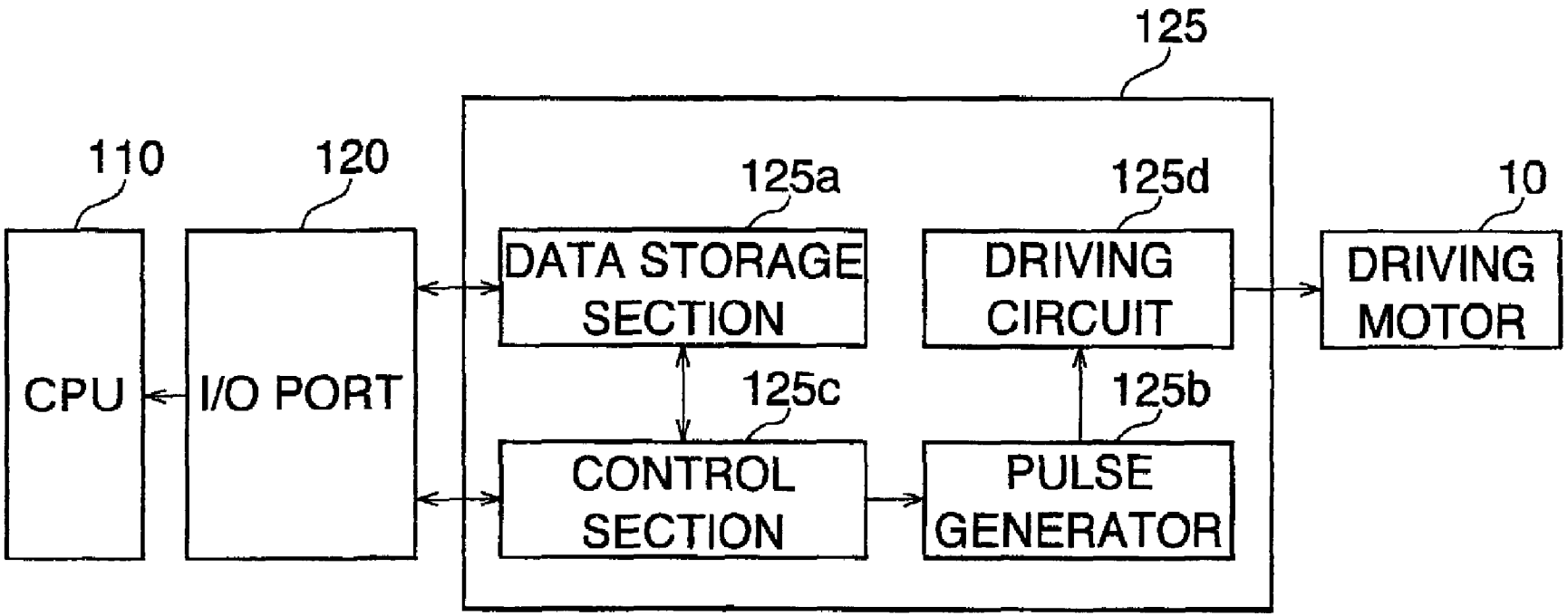
FIG. 8 is a block diagram illustrating a control system of a motor driving pulse output section.

FIG. 8 is a block diagram illustrating a schematic configuration of the motor driving pulse output section 125. As described above, the driving motor 10 is comprised as the so-called stepping motor that rotates a rotation amount proportional to the number of driving pulses at a speed proportional to the frequency of the driving pulses. The motor driving pulse output section 125 has a data storage section 125*a* that stores motor operation parameters such as operation speed data, operation direction data for determining the rotation direction of the driving motor based on a result of the authentication judgment processing and the like, a control section 125*c* that instructs a pulse generator 125*b* to output a pulse for driving the motor based on the operation speed data stored in the data storage section 125*a*, a driving circuit 125*d* for actually operating the driving motor 10 by the motor driving pulse signal generated from the pulse generator 125*b*, and the like.

The data storage section 125*a* stores the information on the motor driving speed associated with the operation position of the switching switch 90. More specifically, when the normal-speed mode is selected by the operation of the switching switch 90, the control section 125*c* instructs the pulse generator 125*b* to output motor driving pulses so that the bill feeding speed is 127 mm/s. Meanwhile, when the high-speed mode is selected by the operation of the switching switch 90, the control section 125*c* instructs the pulse generator 125*b* to output motor driving pulses so that the bill feeding speed is 254 mm/s. Further, when the low-speed mode is selected by the operation of the switching switch 90, the control section 125*c* instructs the pulse generator 125*b* to output motor driving pulses so that the bill feeding speed is 63.8 mm/s.

In addition, when the low-speed mode (OCR mode) is selected, since the bill feeding speed is extremely low, the bill identification accuracy is improved, and further, in such a mode, it is possible to read textual information of, for example, a service ticket, coupon and like.

According to the bill handling apparatus configured as described above, when the bill detecting sensor 18 detects insertion of a bill and becomes ON, the driving motor 10 is forward driven, and the LED 70 is lit. The feeding roller pairs 12, 13 and 14 are thereby driven to rotate in the bill insertion direction to feed the bill inside the apparatus, and the user is notified of the bill being handled to prevent insertion of an additional bill.

The bill is fed inside the apparatus, the bill reading means 20 thereby reads the information, and the control means 30 executes the authentication judgment processing. At this point, in this embodiment, when the bill detecting sensor 18 detects the rear end of the bill (the bill detecting sensor 18 is OFF), the solenoid 54 is energized, and the rotating pieces 52 are thereby driven to rotate and blocks the bill insertion slot 6.

When the bill is judged as being genuine in the above-mentioned authentication judgment processing, the bill is fed to the downstream side. At this point, to be able to support money-back processing and the like that would occur due to some reason, the processing for causing the bill to temporarily wait may be performed. Then, in the stage where the rear end of the bill further fed to the downstream side is detected by the bill passage detecting sensor 60, the driving of the driving motor 10 is halted. With the halt, the driving of the solenoid 54 is made OFF (energization is canceled) to withdraw the rotating pieces 52 from the bill feeding path 5, the bill insertion opening 6 is opened, and the LED 70 is extinguished.

In addition, when the bill is judged being not genuine in the above-mentioned authentication judgment processing, the processing for driving the driving motor 10 reversely is executed in this stage, the shutter mechanism 50 is opened, and the bill is sent back toward the bill insertion opening side. In this send-back processing, in the stage where the rear end of the bill is detecting by the bill detecting sensor 18, the LED 70 is extinguished.

As described above, while the bill inserted inside the bill handling apparatus 1 is fed by the bill feeding mechanism 8, the information of the bill is read by the bill reading means 20. At this point, since the bill feeding mechanism 8 is controlled by the control means 30 to switch the feeding speed between a plurality of kinds (two modes or more), for example, when reading of the bill and the identification processing is ordinarily performed at a high speed (high-speed mode) and a problem arises that the bill identification accuracy deteriorates and the like, by setting the bill feeding speed at a low speed (the normal-speed mode or low-speed mode), it is possible to improve the bill identification accuracy. In other words, even under circumstances where the problem arises that the bill identification accuracy deteriorates and the like and the worker is not able to perform maintenance operation and the like promptly, it is possible to improve the bill identification accuracy with ease.

Further, in the case where the bill handling processing 1 is installed at a location where maintenance operation is easily performed, the bill feeding speed is set at a high speed, and it is thereby possible to give a higher priority to a reduction in the bill identification time. Particularly, in this embodiment, since the switching switch for switching the bill feeding speed is provided in a position enabling a bill inserter to operate the switch, even when the bill identification accuracy deteriorates and the processing such as rejection and the like is executed, by the bill inserter operating the operational switch 90, it is possible to decrease the bill feeding speed to improve the identification accuracy. In other words, the bill inserter is capable of voluntarily selecting the optimal bill feeding speed to improve the bill identification accuracy and enhance the handling speed with ease.

Furthermore, in the above-mentioned configuration, the bill feeding speed is varied according to the switching operation of the switching switch 90, but may be varied on the control program corresponding to the status of the bill feeding, and a processing result of the authentication judgment. For example, the control means 30 may control the feeding speed for feeding the bill along the insertion direction to be different from the feeding speed for feeding back the bill toward the bill insertion slot 6, for example, so that the feeding speed for feeding back is higher, in the case where the bill is not judged as being genuine in the authentication judgment processing of the bill, and the like.

In such a configuration, even when the reject processing arises in reading the bill, it is possible to shorten the time taken to send the bill back to the bill insertion slot, and to enhance the entire processing speed.

Moreover, in the abovementioned construction, a stepping motor that rotates an angle determined by a pulse signal is used in the bill feeding mechanism.

In such a configuration, for example, by inputting predetermined control data (an operation command, operation speed data or the like) to a motor driving pulse output section, it is possible to control the feeding speed with ease.

Moreover, as well as the foregoing, for example, it is possible to control the bill feeding speed as described below.

During feeding of the bill except the bill reading means 20 operating readout of the bill, the bill feeding speed may be made, for example, at a maximum value of the rotation speed of the driving motor 10. For example, the bill feeding speed may be controlled to be made at a maximum value of the rotation speed of the driving motor 10 before starting readout of the bill (for example, before the front end of the bill reaches the bill reading means 20), set at the feeding speed set by the switching switch during readout of the bill, and made again at the maximum value of the rotation speed of the driving motor 10 after finishing readout of the bill (for example, after the rear end of the bill is passed through the reading means 20), and the like. It is thereby possible to shorten the time required for the bill identification time.

In the foregoing, the embodiment of the invention is described, but the invention requires the configuration for being capable of controlling the bill feeding speed in a plurality of kinds (two or more speed modes), and the other configurations are capable of being modified as appropriate. For example, the configuration and arrangement pattern of the reading means (sensor) for reading a bill, method of reading the bill, method of performing the bill authentication judgment processing and the like are not limited to the above-mentioned embodiment, and are capable of being carried into practice with various modifications thereof.

The bill handling apparatus of the invention is capable of being incorporated into various kinds of apparatuses that provide products and/or service by inserting a bill, while being not limited to a game media lending apparatus. Further, this embodiment describes the apparatus for handling bills as an example, but the invention is applicable to apparatuses for making an authentication judgment on gold certificates, securities and the like.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

The invention claimed is:

1. A bill handling apparatus configured to be incorporated in equipment, the apparatus comprising:

a bill insertion slot into which a bill is inserted;

a bill feeding mechanism to feed the bill inserted from the bill insertion slot in an insertion direction;

a bill reading section to read text written on the bill fed by the bill feeding mechanism in a course of bill insertion;

a control section to control a bill feeding speed of the bill feeding mechanism for a plurality of speeds; and an operational switch to generate a signal for the control section to switch the bill feeding speed in accordance with an operation by a bill inserter such that a decrease of the bill feeding speed results in an increase of a bill identification accuracy by the bill reading section, wherein the operational switch is arranged in an exposed portion of the bill insertion apparatus configured to be incorporated in the equipment, at a position enabling the bill inserter to switch the bill feeding speed from outside the equipment.

2. The bill handling apparatus according to claim 1, wherein the bill feeding mechanism is configured to feed the bill back to the bill insertion slot, and the control section controls a feeding speed for feeding the bill along the insertion direction to be different from a feeding speed for feeding the bill back toward the bill insertion slot.

3. The bill handling apparatus according to claim 1, wherein the bill feeding mechanism is comprised of a stepping motor that rotates at an angle determined by a pulse signal.

4. The bill handling apparatus according to claim 3, wherein the bill feeding mechanism has the motor, the control section has a motor driving pulse output section, and the motor driving pulse output section comprises:

a pulse generator to generate the pulse signal, a data storage section to store operation speed data, a control section to instruct the pulse generator to output a pulse for driving the motor based on the operation speed data stored in the data storage section, and a driving circuit to operate the motor by the pulse signal generated from the pulse generator.

5. The bill handling apparatus according to claim 4, wherein a switch signal generating section has an operational switch installed in an operation position enabling a bill inserter to operate the switch, and the data storage section stores the data on a motor operation speed associated with the operation position of the operational switch.

6. The bill handling apparatus according to claim 1, wherein the bill feeding mechanism has a motor, the switch signal generating section has an operational switch installed in a position enabling the bill inserter to operate the switch, and the bill feeding speed is set at a maximum value of a rotation speed of the motor before starting a readout of the bill, at a feeding speed set by the operational switch during the readout of the bill, and at the maximum value of the rotation speed of the motor after finishing the readout of the bill.

7. The bill handling apparatus according to claim 1, wherein the control section controls a bill feeding speed at which the bill is fed back to the bill insertion slot to be higher than a bill filling speed at which the bill is fed in the insertion direction.

8. A bill handling apparatus configured to be incorporated in equipment, the apparatus comprising:

a bill insertion slot into which a bill is inserted;

a bill feeding mechanism to feed the bill inserted from the bill insertion slot in an insertion direction;

a bill reading section to read text written on the bill fed by the bill feeding mechanism in a course of bill insertion; and a control section to control a bill feeding speed of the bill feeding mechanism for a plurality of speeds, wherein the bill feeding mechanism is configured to feed the bill back to the bill insertion slot, and the control section controls a bill feeding speed at which the bill is fed back to the bill insertion slot to be higher than a bill filling speed at which the bill is fed in the insertion direction.

* * * * *